US005731791A

United States Patent [19]

Jang

[11] Patent Number: 5,731,791

[45] Date of Patent: Mar. 24, 1998

[54] ANTENNA CONNECTING DEVICE FOR PORTABLE RADIO SETS

[75] Inventor: Chang-Weon Jang, Gumi, Rep. of Korea

[73] Assignee: SamSung Electronics Co., Ltd., Kyungki-do, Rep. of Korea

[21] Appl. No.: 585,589

[22] Filed: Jan. 16, 1996

[30] Foreign Application Priority Data

Apr. 27, 1995 [KR] Rep. of Korea ..... 10172/1995

[51] Int. Cl.[6] ..... H01Q 1/24

[52] U.S. Cl. ..... 343/702; 343/895; 343/901

[58] Field of Search ..... 343/702, 895, 343/900, 901; H01Q 1/24

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson, Jr. | 343/702 |
| 5,204,687 | 4/1993 | Elliott et al. | 343/702 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/895 |
| 5,389,938 | 2/1995 | Harrison | 343/702 |
| 5,426,440 | 6/1995 | Shimada | 343/729 |
| 5,434,582 | 7/1995 | Koike et al. | 343/702 |
| 5,438,339 | 8/1995 | Itoh et al. | 343/702 |
| 5,446,469 | 8/1995 | Makino | 343/702 |
| 5,455,595 | 10/1995 | Yokoyama et al. | 343/702 |
| 5,467,096 | 11/1995 | Takamoto et al. | 343/702 |
| 5,469,177 | 11/1995 | Rush et al. | 343/702 |
| 5,479,178 | 12/1995 | Ha | 343/702 |
| 5,594,457 | 1/1997 | Wingo | 343/895 |

*Primary Examiner*—Hoanganh T. Le
*Attorney, Agent, or Firm*—Robert E. Bushnell, Esq.

[57] ABSTRACT

An antenna configuration for a portable radio set provides a helical antenna, a rod antenna and an antenna connecting device that selectively connects the two antennas to a printed substrate to enable their operation. When the rod antenna is partially retracted within the interior of a body housing beyond a threshold point where the antenna connecting device becomes electrically disengaged from the rod antenna, the antenna connecting device elastically returns to an original position and becomes electrically connected to the helical antenna. Alternatively, when the rod antenna is fully extended from the body housing, the antenna connecting device is electrically connected to the rod antenna. The present invention provides advantages in that a large amount of radiating power may be distributed in accordance with the length of the rod antenna, thereby minimizing any radiating interference caused by a user's body and reducing the loss of radiating power.

24 Claims, 2 Drawing Sheets

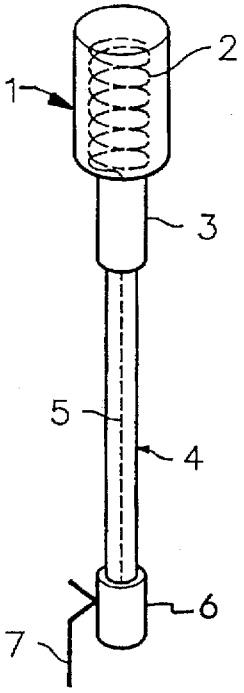
*Conventional*
FIG. 1
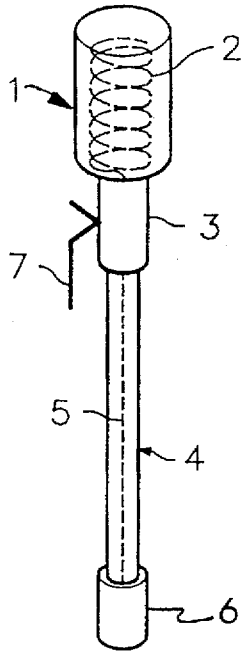
*Conventional*
FIG. 2
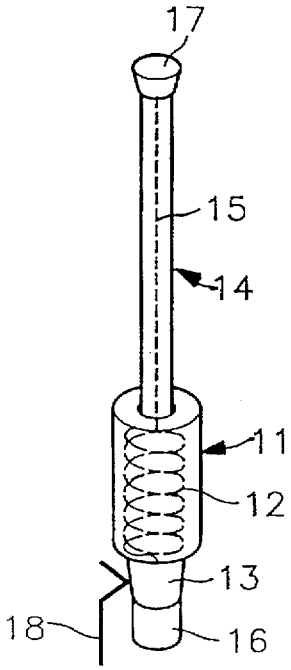
*Conventional*
FIG. 3
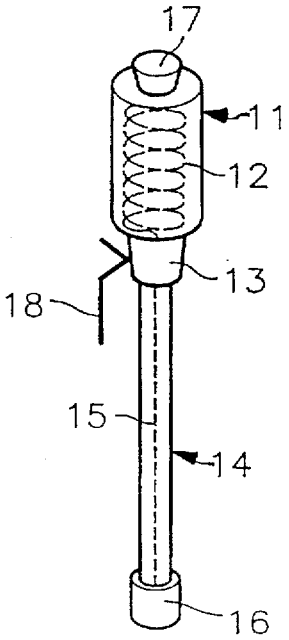
*Conventional*
FIG. 4

ANTENNA CONNECTING DEVICE FOR PORTABLE RADIO SETS

CROSS-REFERENCE TO RELATED APPLICATIONS

This application makes reference to, incorporates the same herein, and claims all benefits accruing under 35 U.S.C. §119 from an application for Antenna Connecting Device For Portable Radio Sets earlier filed in the Korean Industrial Property Office on 27 Apr. 1995 and there assigned Ser. No. 10172/1995.

BACKGROUND OF THE INVENTION

The present invention relates to an antenna connecting device for a portable radio set, and more particularly, to an antenna connecting device capable of separately operating a helical antenna and a rod antenna in a portable radio set.

Antenna configurations used in portable radio sets often utilize both a rod antenna and a helical antenna. One prior art example of this configuration is disclosed in U.S. Pat. No. 4,868,576 entitled Extendable Antenna For Portable Cellular Telephones With Ground Radiator issued to Johnson et al. This type of configuration inherently requires a means for electrically connecting the two antenna to applicable radio circuitry. Various types of these connecting means are disclosed in U.S. Pat. No. 5,317,325 entitled Radio Antennas issued to Bottomley. In particular, Bottomley '325 avoids the use of sliding metal connectors, and instead utilizes components that provide a capacitive link between a rod antenna and a matching network. While the type of conventional art disclosed in Bottomley '325 possesses merit in its own right, I believe that an improved device for providing electrical connections between antennas in a portable radio set can be contemplated.

SUMMARY OF THE INVENTION

Accordingly, it is an object of the present invention to provide an improved antenna connecting device for a portable radio set.

It is another object to provide an antenna connecting device that connects directly to connectors of a helical antenna and a rod antenna to enable their respective operation.

It is still another object to provide an antenna connecting device that provides an electrical connection to enable selective operation of a rod antenna and a helical antenna.

It is yet another object to provide an antenna connecting device for maintaining operating characteristics of a rod antenna even though the rod antenna is disposed within a helical antenna when extended.

These and other objects can be achieved according to the principles of the present invention with an antenna configuration for a portable radio set having a helical antenna, a rod antenna and an antenna connecting device that selectively connects the two antennas to a printed substrate to enable their operation. When the rod antenna is partially retracted within the interior of a body housing beyond a threshold point where the antenna connecting device becomes electrically disengaged from the rod antenna, the antenna connecting device elastically returns to an original position and becomes electrically connected to the helical antenna. Alternatively, when the rod antenna is fully extended from the body housing, the antenna connecting device is electrically connected to the rod antenna.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein:

FIG. 1 is a view illustrating a connecting state when an antenna is extended in a conventional portable radio set;

FIG. 2 is a view illustrating a connecting state when an antenna is retracted in a conventional portable radio set;

FIG. 3 is a view illustrating a connecting state when an antenna is extended in another conventional portable radio set;

FIG. 4 is a view illustrating a connecting state when an antenna is retracted in another conventional portable radio set;

DETAILED DESCRIPTION OF THE PREFERRED EMBODIMENTS

Figure 5:
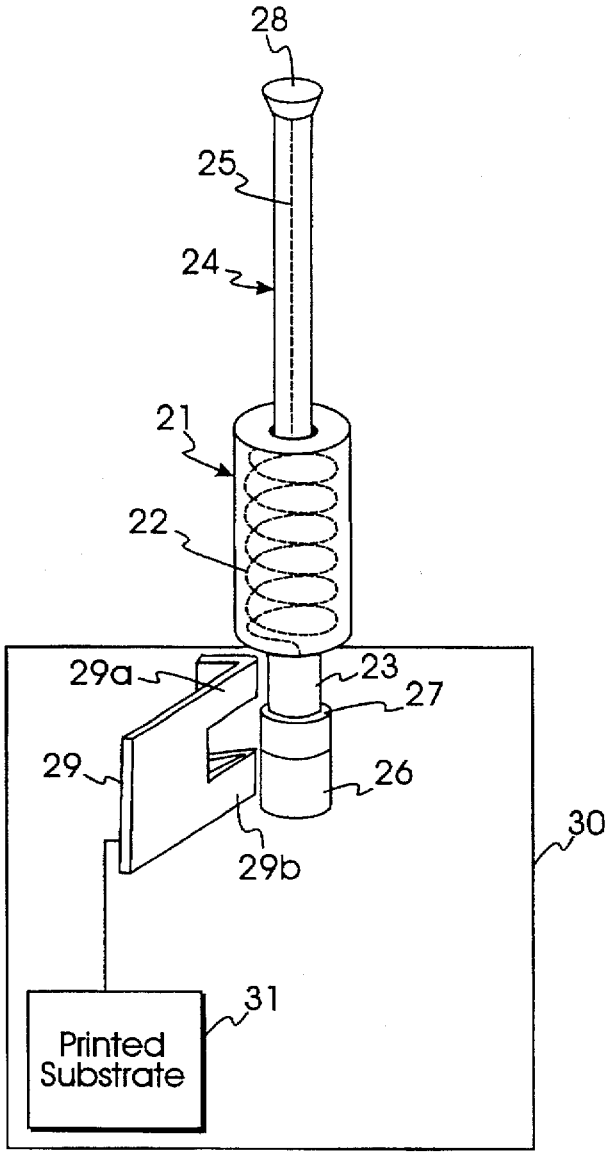
FIG. 5 is a view illustrating a connecting state when an antenna is extended in a portable radio set constructed according to the principles of the present invention.

Turning now to the drawings and referring to FIGS. 1 and 2, an antenna configuration having an antenna connecting device in a portable radio set as disclosed in Japanese Patent Provisional Publication No. 3-24503 is illustrated. The antenna configuration of FIGS. 1 and 2 includes a helical antenna 1 having a helical winding 2 positioned within an antenna housing. A helical antenna connector 3 extends downwardly from a bottom portion of helical antenna 1. A rod antenna 4 having a stainless core wire 5 extends downwardly from helical antenna connector 3. A stopper 6 is coupled to a bottom portion of rod antenna 4. At a top portion of a body housing (not shown), an antenna connecting means 7 electrically connectable to helical antenna connector 3 and stopper 6 is installed. Antenna connecting means 7 provides an electrical connection to a printed substrate.

When rod antenna 4 is extended from the body housing, stopper 6 formed at the bottom portion of rod antenna 4 is electrically connected to antenna connecting means 7 at the top portion of the body housing to thereby operate the antenna configuration. This connecting state is represented in FIG. 1. When rod antenna 4 is retracted into the body housing, helical antenna connector 3 positioned at the bottom portion of helical antenna 1 is electrically connected to antenna connecting means 7 at the top portion of the body housing to thereby operate helical antenna 1. This connecting state is represented in FIG. 2.

The antenna configuration shown in FIGS. 1 and 2, however, has a defect in that since helical antenna 1 is positioned above rod antenna 4, the center of the gravity of the radio set using the antenna configuration is placed such that the antenna configuration swings and rotting noise may be generated. Also, such a configuration has an unaesthetic appearance.

To overcome the foregoing defects, another conventional embodiment will now be explained with reference to FIGS. 3 and 4. The antenna configuration of FIGS. 3 and 4 includes a helical antenna 11 having a helical winding 12 positioned within an antenna housing. A helical antenna connector 13 extends downwardly from helical antenna 11. A rod antenna 14 having a core wire 15 is retractable and extendable through a hollow, cylindrical hole formed as a center shaft of helical antenna 11. A stopper 16 is connected to a bottom portion of rod antenna 14, and a knob 17 is connected to a top portion of rod antenna 14. At a top portion of a body housing (not shown), antenna connecting means 18 electrically connectable to helical antenna connector 13 and stopper 16 is installed. Antenna connecting means 18 provides an electrical connection to a printed substrate.

When rod antenna 14 is retracted within the interior of the body housing through the cylindrical, center shaft of helical antenna 11, as depicted in FIG. 4, antenna connecting means 18 is electrically connected to helical antenna connector 13 and only helical antenna 11 is operated. On the other hand, when rod antenna 14 is extended, as depicted in FIG. 3, stopper 16 of rod antenna 14 is electrically connected to helical antenna connector 13 of helical antenna 11, and antenna connecting means 18 is electrically connected to helical antenna connector 13. As a result, both helical antenna 11 and rod antenna 14 are operated.

When only helical antenna 11 is operated by retracting rod antenna 14, it is possible to detect an incoming call as a high frequency signal. Moreover, an insulator (not shown) positioned on the upper portion of rod antenna 14 and having a length that is greater than or equal to the length of helical antenna 11 eliminates mutual interference between rod antenna 14 and helical antenna 11. Therefore, when rod antenna 14 is retracted, a high frequency signal is radiated only to helical antenna 11.

When extended, rod antenna 14 passes through the cylindrical, center shaft of helical antenna 11 to extend fully from the body housing. In this state, stopper 16 formed at the bottom portion of rod antenna 14 is electrically connected to helical antenna connector 13. As a result, rod antenna 14 can reduce the loss of actual radiating power at its upper portion.

Antenna connecting device 18 described above electrically connects to helical antenna connector 13 regardless of whether rod antenna 14 is extended or retracted. Because of this condition, in order to operate rod antenna 14 (i.e., in conjunction with helical antenna 11), stopper 16 of rod antenna 14 must be moved all the way up to helical antenna connector 13 so that stopper 16 connects electrically to antenna connecting device 18 through helical antenna connector 13. This requirement for operation of rod antenna 14 can be inconvenient and time consuming for the user. Also, it is possible to falsely connect helical antenna connector 13 to stopper 16 of rod antenna 14. Accordingly, an improved design for an antenna connecting device should be contemplated.

Figure 6:
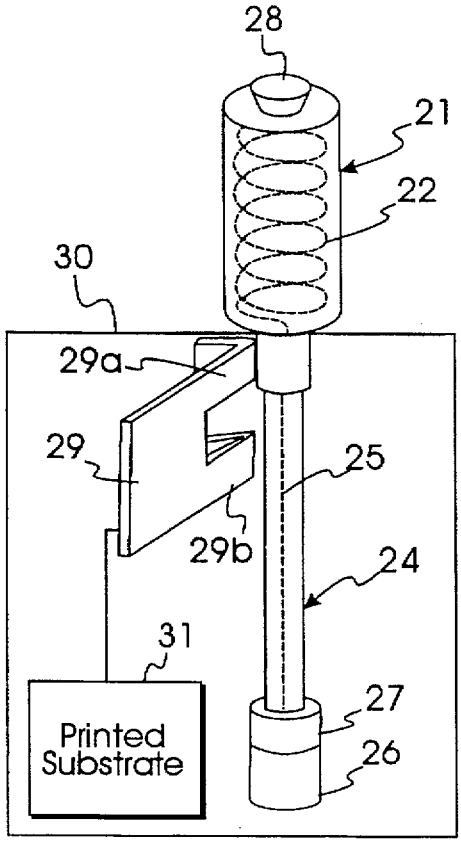
FIG. 6 is a view illustrating a connecting state when an antenna is retracted in a portable radio set constructed according to the principles of present invention.

FIG. 5 is a view illustrating a connecting state when an antenna is extended, and FIG. 6 is a view illustrating a connecting state when the antenna is retracted in a portable radio set constructed according to the principles of present invention.

Referring to FIGS. 5 and 6, an explanation of the antenna connecting device constructed according to the principles of the present invention will now be given in detail. In FIGS. 5 and 6, a helical antenna 21 installed to protrude from a top portion of a body housing 30 includes a helical winding 22 positioned within an antenna housing. A helical antenna connector 23 is electrically coupled to helical winding 22 and extends downwardly from helical antenna 21. A rod antenna 24 having a core wire 25 is retractable and extendable through a hollow, cylindrical hole formed as a center shaft of helical antenna 21. A rod antenna connector 26 electrically coupled to core wire 25 is connected to a bottom portion of rod antenna 24, an insulator 27 is concentrically positioned adjacent to rod antenna connector 26, and a knob 28 is connected to a top portion of rod antenna 24. Within the body housing 30, antenna connecting means 29 having first and second connecting arms **29*a* and 29*b* is installed. When rod antenna 24 is extended, as shown in FIG. 5, second connecting arm 29*b* of antenna connecting means 29 electrically connects to rod antenna connector 26. When rod antenna 24 is retracted, as shown in FIG. 6, first connecting arm 29*a* of antenna connecting means 29 electrically connects to helical antenna connector 23. Antenna connecting means 29 provides an electrical connection to a printed substrate 31**.

Antenna connecting means 29 installed within the body housing 30 is comprised of first connecting arm **29*a* that is electrically connectable to helical antenna 21 through helical antenna connector 23, and second connecting arm 29*b* that is electrically connectable to rod antenna 24 through rod antenna connector 26. First and second connecting arms 29*a* and 29*b* are constructed with an electrically conductive plate spring that exhibits elasticity. The width (i.e., diameter) of rod antenna connector 26 is larger than the width of helical antenna connector 23. When rod antenna 24 is retracted, first connecting arm 29*a* of antenna connecting means 29 is electrically connected to helical antenna connector 23. When rod antenna 24 is extended, second connecting arm 29*b* of antenna connecting means 29 is electrically connected to rod antenna connector 26. Insulator 27 is installed above rod antenna connector 26 so that, when extended, rod antenna 24 is electrically insulated from helical antenna connector 23**.

The operation and effects of the present invention constructed according to the description provided above will now be explained.

Antenna connecting device 29 is fixedly installed within the body housing 30 of the portable radio set, helical antenna 21 is installed on a top portion of the body housing 30, and rod antenna 24 is installed to retract within and extend from the body housing through the cylindrical, center shaft of helical antenna 21.

When rod antenna 24 is retracted, antenna connecting means 29 provided with first and second connecting arms **29*a* and 29*b* is electrically connected to helical antenna connector 23 via first connecting arm 29*a*, thereby enabling operation of only helical antenna 21. In contrast, when rod antenna 24 is extended and rod antenna connector 26 is electrically connected to second connecting arm 29*b*, first connecting arm 29*a* is separated from helical antenna connector 23. Accordingly, only rod antenna 24** is operated.

As shown in FIG. 5, when rod antenna 24 is extended upwardly by using knob 28, insulator 27 provided at the lower portion of rod antenna 24 outwardly displaces antenna connecting means 29 and is moved upwardly until engaging the lower portion of helical antenna connector 23. Once insulator 27 engages helical antenna connector 23, rod antenna 24 can not be extended upwardly any further. In this state, rod antenna connector 26 is electrically connected to second connecting arm **29*b* of antenna connecting means 29, and rod antenna 24 can be operated. In other words, first connecting arm 29*a* remains electrically connected to helical antenna connector 23 as rod antenna 24 is being extended upwardly from the body housing 30 until insulator 27 engages second connecting arm 29*b* causing elastic displacement of antenna connecting means 29. As antenna connecting means 29 is displaced, first connecting arm 29*a* of antenna connecting means 29 moves away from helical antenna connector 23, and operation of helical antenna 21 is disabled. As a result, only rod antenna 24** can be operated.

When rod antenna 24 is extended, a large amount of radiating power can be distributed in accordance with its length, thereby minimizing any radiating interference caused by a user's body.

As rod antenna 24 is moved downwardly (i.e., retracted) from the extended position, rod antenna connector 26 becomes disengaged from second connecting arm 29*b* of antenna connecting means 29 in accordance with the downward movement of rod antenna 24. After rod antenna connector 26 disengages second connecting arm 29*b*, antenna connecting means 29 is elastically restored back to its original position and first connecting arm 29*a* is electrically connected to helical antenna connector 23 so that only helical antenna 21 can be operated.

While rod antenna 24 is being retracted, any received high frequency signal is coupled to antenna connecting means 29 via helical antenna connector 23. Antenna connecting means 29 is electrically connected to a feeding connector connected to a printed substrate. Accordingly, the received high frequency signal can be impedance matched through a matching circuit. While rod antenna 24 is being retracted, since rod antenna 24 is not operated, high frequency signals from an incoming call can only be received by helical antenna 21, and high frequency signals can only be radiated by helical antenna 21.

As described above, an antenna configuration for the portable radio set constructed according to the principles of the present invention provides that when rod antenna 24 is partially retracted within the interior of the body housing 30 beyond a threshold point where second connecting arm 29*b* of antenna connecting means 29 becomes disengaged from rod antenna connector 26 and insulator 27, antenna connecting means 29 elastically returns to an original position and first connecting arm 29*a* of antenna connecting means 29 becomes electrically connected to helical antenna connector 23 so that only helical antenna 21 is operated. On the other hand, when rod antenna 24 is fully extended from the body housing 30, rod antenna 24 extends through the center shaft of helical antenna 21 and second connecting arm 29*b* of antenna connecting means 29 is electrically connected to rod antenna connector 26 so that only rod antenna 24 is operated. Accordingly, the present invention provides advantages in that a large amount of radiating power may be distributed in accordance with the length of rod antenna 24, thereby minimizing any radiating interference caused by the user's body and reducing the loss of radiating power.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A device for a portable radio set, comprising:

helical antenna means comprising a helical winding, said helical antenna means installed to protrude from a top portion of a body housing of said portable radio set;

rod antenna means installed to extend from and retract into said body housing through a center shaft of said helical antenna means; and antenna connecting means installed within said body housing for electrically connecting to said helical antenna means and said rod antenna means to enable selective operation of said helical antenna means and said rod antenna means, respectively, said antenna connecting means oriented in a first position to electrically connect to said helical antenna means and enable operation of only said helical antenna means when said rod antenna means is retracted into said body housing, said antenna connecting means oriented in a second position displaced from said first position to electrically connect to said rod antenna means and enable operation of only said rod antenna means when said rod antenna means is extended from said body housing.

2. The device as claimed in claim 1, wherein said rod antenna means comprises a top portion for distributing radiating power when said rod antenna means is extended.

3. The device as claimed in claim 1, further comprising:

a helical antenna connector installed on a bottom portion of said helical antenna means and coupled to said helical winding to electrically connect said antenna connecting means to said helical antenna means when said rod antenna means is retracted into said body housing.

4. The device as claimed in claim 3, further comprising:

a rod antenna connector installed on a bottom portion of said rod antenna means and coupled to a wire core of said rod antenna means to electrically connect said antenna connecting means to said rod antenna means when said rod antenna means is extended from said body housing;

an insulator positioned adjacent to said rod antenna connector to separate said rod antenna connector from said helical antenna connector when said rod antenna means is extended from said body housing; and a knob positioned on a top portion of said rod antenna means.

5. The device as claimed in claim 4, wherein said antenna connecting means comprises an electrically conductive plate spring.

6. The device as claimed in claim 5, wherein said electrically conductive plate spring comprises first and second connecting arms, said first connecting arm electrically connecting to said helical antenna connector when said rod antenna means is retracted into said body housing, and said second connecting arm electrically connecting to said rod antenna connector when said rod antenna means is extended from said body housing.

7. The device as claimed in claim 6, wherein said rod antenna connector exhibits a first linear dimension that is larger than a second linear dimension exhibited by said helical antenna connector.

8. A device for a portable radio set, comprising:

helical antenna means comprising a helical winding, said helical antenna means installed to protrude from a top portion of a body housing of said portable radio set;

a helical antenna connector installed on a bottom portion of said helical antenna means and electrically coupled to said helical winding;

rod antenna means comprising a core wire, said rod antenna means installed to extend from and retract into said body housing through a center portion of said helical antenna means;

a rod antenna connector installed on a bottom portion of said rod antenna means and electrically coupled to said core wire; and antenna connecting means installed within said body housing and having first and second connecting arms, said first connecting arm electrically connecting to said helical antenna connector to broadcast electromagnetic signals from said antenna connecting means via said helical antenna means without broadcasting said electromagnetic signals via said rod antenna means when said rod antenna means is retracted into said body housing, and said second connecting arm electrically connecting to said rod antenna connector to broadcast electromagnetic signals from said antenna connecting means via said rod antenna means without broadcasting said electromagnetic signals via said helical antenna means when said rod antenna means is extended from said body housing.

9. The device as claimed in claim 8, wherein said antenna connecting means comprises an electrically conductive plate spring.

10. The device as claimed in claim 9, further comprising an insulator positioned adjacent to said rod antenna connector to separate said rod antenna connector from said helical antenna connector when said rod antenna means is extended from said body housing.

11. The device as claimed in claim 8, wherein said rod antenna connector exhibits a first linear dimension that is larger than a second linear dimension exhibited by said helical antenna connector.

12. The device as claimed in claim 11, further comprising an insulator positioned adjacent to said rod antenna connector to separate said rod antenna connector from said helical antenna connector when said rod antenna means is extended from said body housing.

13. A device for a portable radio set, comprising:

helical antenna means comprising a helical winding, said helical antenna means installed to protrude from a top portion of a body housing of said portable radio set;

a helical antenna connector installed on a bottom portion of said helical antenna means and electrically coupled to said helical winding;

rod antenna means comprising a core wire, said rod antenna means installed to extend from and retract into said body housing through a center portion of said helical antenna means;

a rod antenna connector installed on a bottom portion of said rod antenna means and electrically coupled to said core wire;

insulating means positioned adjacent to said rod antenna connector for separating said rod antenna connector from said helical antenna connector when said rod antenna means is extended from said body housing; and antenna connecting means installed within said body housing and having first and second elastic members, said antenna connecting means oriented in a first position to electrically connect said first elastic member to said helical antenna connector and enable operation of said helical antenna means while preventing radiation of electromagnetic signals from said antenna connecting means via said rod antenna means when said rod antenna means is retracted into said body housing, and said antenna connecting means oriented in a second position displaced from said first position to electrically connect said second elastic member to said rod antenna connector and enable operation of said rod antenna means while preventing radiation of electromagnetic signals from said antenna connecting means via said helical antenna means when said rod antenna means is extended from said body housing.

14. The device as claimed in claim 13, wherein said rod antenna connector exhibits a first linear dimension that is larger than a second linear dimension exhibited by said helical antenna connector.

15. The device as claimed in claim 13, wherein said antenna connecting means comprises an electrically conductive plate spring.

16. The device as claimed in claim 13, wherein said antenna connecting means moves from said second position to said first position in response to downward movement of said rod antenna means beyond a threshold point where said insulating means becomes disengaged from said second elastic member.

17. The device as claimed in claim 16, wherein said antenna connecting means comprises an electrically conductive plate spring.

18. An antenna configuration, comprising:

a body housing;

a helical antenna comprising a helical winding, said helical antenna installed to protrude from a top portion of said body housing;

a first connector installed on a bottom portion of said helical antenna and electrically coupled to said helical winding;

a rod antenna comprising a core wire, said rod antenna installed to extend from and retract into said body housing through a center axis of said helical winding;

a second connector installed on a bottom portion of said rod antenna and electrically coupled to said core wire; and antenna connecting means installed within said body housing and having first and second elastic members for providing an electrical connection to a printed substrate within said body housing, said antenna connecting means oriented in a first position to electrically connect said first elastic member to said first connector and enable broadcast of electromagnetic signals from the printed substrate via said helical antenna while preventing broadcast of said electromagnetic signals via said rod antenna when said rod antenna is retracted into said body housing, said antenna connecting means oriented in a second position displaced from said first position to electrically connect said second elastic member to said second connector and enable broadcast of electromagnetic signals from the printed substrate via said rod antenna while preventing broadcast of said electromagnetic signals via said helical antenna when said rod antenna is extended from said body housing.

19. The antenna configuration as claimed in claim 18, wherein said antenna connecting means comprises an electrically conductive plate spring.

20. The antenna configuration as claimed in claim 19, further comprising an insulator positioned adjacent to said second connector for separating said second connector from said first connector when said rod antenna is extended from said body housing.

21. The device as claimed in claim 6, said first and second connecting arms being permanently electrically connected together.

22. The device as claimed in claim 8, said first and second connecting arms being permanently electrically connected together.

23. The device as claimed in claim 13, said first and second elastic members being permanently electrically connected together.

24. The device as claimed in claim 18, said first and second elastic members being permanently electrically connected together.

* * * * *